US005624157A

United States Patent [19]

Kostuk

[11] Patent Number: 5,624,157

[45] Date of Patent: Apr. 29, 1997

[54] COVER FOR FOLDING LOUNGE

[76] Inventor: Teresa Kostuk, 505 Fifth Ave. South, Ste. A, Naples, Fla. 33940

[21] Appl. No.: 494,949

[22] Filed: Jun. 26, 1995

[51] Int. Cl.[6] ..... A47C 31/00

[52] U.S. Cl. ..... 297/228.13; 297/218.1; 297/219.1; 297/229; 297/228.1; 5/656; 797/900 AC

[58] Field of Search ..... 297/228.13, 229, 297/228.1, 219.1, 218.3, 218.1, 225, 228.12, DIG. 900; 5/638, 656, 461; 3/496, 498

[56] References Cited

U.S. PATENT DOCUMENTS

| | | | |
|---|---|---|---|
| 3,266,061 | 8/1966 | Fuechsel | 5/461 |
| 3,897,102 | 7/1975 | Lemaire . | |
| 4,207,635 | 6/1980 | Leroy | 5/656 |
| 4,553,785 | 11/1985 | Duke et al. | 297/229 |
| 4,606,086 | 8/1986 | Rowland . | |
| 4,891,854 | 1/1990 | Funkelstein | 5/638 |
| 5,222,779 | 6/1993 | Johnson | 5/638 |
| 5,237,713 | 8/1993 | Prager | 5/461 |
| 5,297,850 | 3/1994 | Guleserian . | |
| 5,326,152 | 7/1994 | Baron . | |
| 5,476,308 | 12/1995 | St. Germain | 297/229 |

*Primary Examiner*—Milton Nelson, Jr.
*Assistant Examiner*—Anthony D. Barfield
*Attorney, Agent, or Firm*—Merrill N. Johnson

[57] ABSTRACT

A fabric cover for a lounge chair to be fitted onto an adjustable folding metal frame, the frame being constructed principally of tubular metal including U-shaped foot and head portions. The cover includes a pocket fitted over the U-shaped foot portion of the frame and a second pocket fitted over the U-shaped head portion of the frame. The second pocket includes a padded inner lining and contains a hole fitted to the face of a person lying on the lounge chair on his or her stomach. The cover also includes two similar rectangular side panels attached to the opposite sides of the center portion of the cover, each having along its edge opposite to the edge attached to the center portion of the cover attachments for joining two side panel edges together, in order to secure the cover onto the metal frame.

2 Claims, 1 Drawing Sheet

COVER FOR FOLDING LOUNGE

FIELD OF INVENTION

My invention relates to folding lounge chairs and more particularly to a unique cover for a conventional metal frame for a folding lounge chair.

BACKGROUND OF THE INVENTION

Uncounted thousands of folding lounge chairs in a variety of shapes and sizes are sold each year for use on beaches, beside swimming pools and on patios and balconies. One of the most common and least expensive folding lounges consists of an adjustable tubular metal frame covered by a flexible plastic cover and sold in K-Mart and similar discount stores for less than $25.

The metal frame of these popular folding lounges is quite sturdy and always outlasts its plastic cover which in use soon tends to rip or tear or develop a permanent sag and thus fails to comfortably support a person lying or sitting on the lounge.

SUMMARY OF THE INVENTION

I have invented a unique cover for an adjustable tubular metal frame—the same frame conventionally sold with a flexible plastic cover. My cover does not easily rip or tear nor will it develop an uncomfortable sag or fail to properly support the weight of the person lying or sitting on the lounge.

Moreover, when a person wishes to lie on their stomach, my lounge cover permits that person to lie properly with his or her face looking straight down onto the beach or lawn or patio tile, the most healthful position for relief of tension and to prevent strained neck muscles. Moreover, the person on their stomach may conveniently drink, eat or read a book lying on the surface beneath his or her head.

The adjustable metal frame onto which my cover fits consists of two identical U-shaped ends each formed from a piece of tubing, two identical U-shaped legs each formed from a piece of tubing, two identical straight pieces of the same tubing, and four identical mechanisms. One end of one of the U-shaped ends and one end of one of the U-shaped legs and one end of one of the straight pieces of tubing are connected to each one of the four mechanisms which permit incremental adjustment of the position of the two U-shaped ends to form the adjustable metal frame.

Conventionally, when the two ends are horizontal, the lounge measures about 70 inches long and 22 inches wide and the tubing used is ¾ inch outside diameter aluminum tubing.

My cover is made of a sturdy breathable woven fabric that preferably has a brightly colored striped pattern. A feature of my invention is that the entire cover can be easily removed from the frame to be washed, cleaned or replaced by a similar cover having a different color or pattern. The cover is preferably formed from three panels of the same patterned fabric. The first panel includes a pocket at one end which is sized to fit over one end of the lounge called the foot end. The opposite end also includes a pocket sized to fit over the opposite or head end of the lounge.

This pocket contains a layer of padding beneath of upper layer of fabric. The pocket and its padding has a hole somewhat above the center of the pocket. The hole is sized to accommodate the face of a person lying face down on the lounge, thereby permitting the person to read a book, eat or drink beverages through a straw.

A panel of the same fabric approximately 12 inches in length is sewn to each side of the center portion of the first panel and preferably a length of one half of a separable zipper is sewn to the side of each of the two panels opposite the side of the panel sewn to the first panel. Alternatively, a series of snaps or clips or two strips of plastic hook and loop material could be used instead of the two zipper halves as the means for joining the two panels together beneath the frame.

To fit my cover onto the frame, the two ends of the frame are adjusted into a near vertical position and the pocket sized to fit over the foot end of the frame is slipped over the foot end and then the padded pocket with the hole is slipped over the head end of the frame. The two side panels are then fitted over the frame's two straight lengths of tubing and zipped together beneath the center portion of the frame, thereby securing the cover to the frame and preventing any sagging of the first panel.

DESCRIPTION OF THE PREFERRED EMBODIMENT

Figure 1:
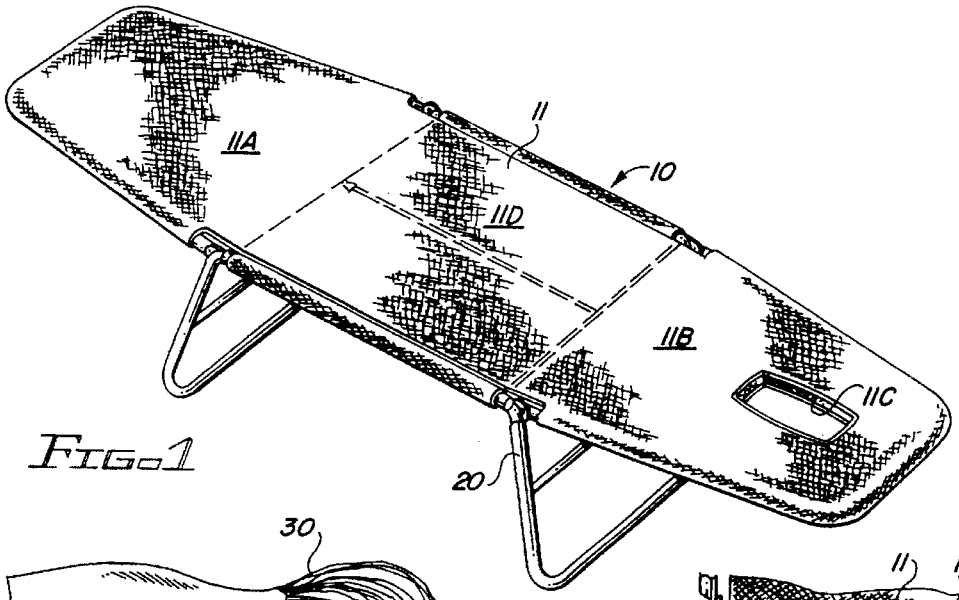
FIG. 1 is a perspective view of the preferred embodiment of my cover mounted on an adjustable tubular metal frame.
Figure 3:
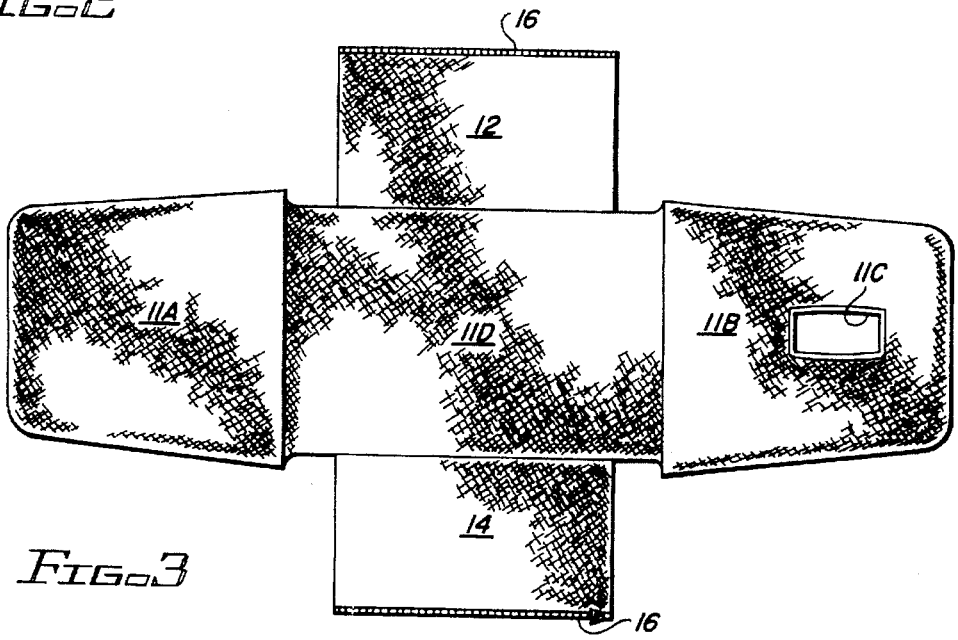
FIG. 3 is a plan view of the bottom side of my cover with its two side panels spread out and unzipped.

FIG. 1 of the appended drawings shows a preferred embodiment of my cover 10 fitted onto an adjustable tubular metal frame 20. Cover 10 consists of an elongated first panel 11 made of sturdy woven fabric and two identical rectangular side panels 12 and 14 sewn to the opposite sides of the center portion 11D of first panel 11 as best shown in FIG. 3.

One end of panel 11 referred to as its foot end is formed into a pocket 11A sized to fit over one of the two tubular U-shaped ends of adjustable lounge frame 20. The opposite end of panel 11 referred to as its head end is formed into a pocket 11B sized to fit over the other tubular end of frame 20.

Figure 2:
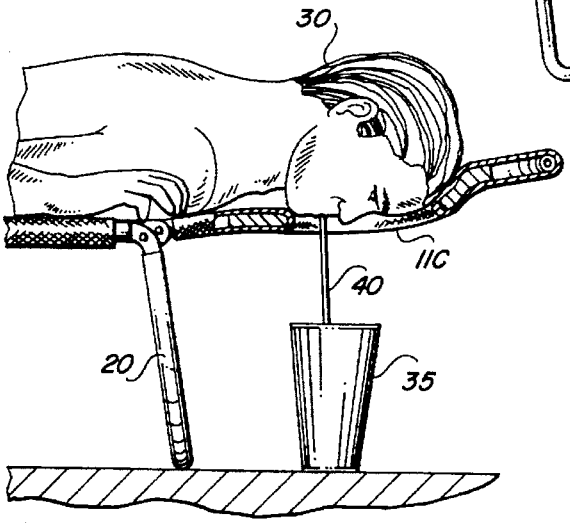
FIG. 2 is a side elevational view partially cutaway, of my cover on an adjustable metal frame showing a person lying on his stomach and drinking through a straw a beverage located on the ground.

However, pocket 11B differs from pocket 11A in that 11B includes a layer of padding sewn within the pocket and it also includes a hole 11C through the middle portion of pocket 11B which is positioned and sized to comfortably support the face of a person 30 who is lying face down on the lounge. This feature of my lounge cover permits the person to lie with his face straight down, the most healthful position for relief of tension and to prevent strained neck muscles. Additionally, person 30 is able to read a book, eat or drink a beverage 35 through a straw 40 as shown in FIG. 2.

Figure 4:
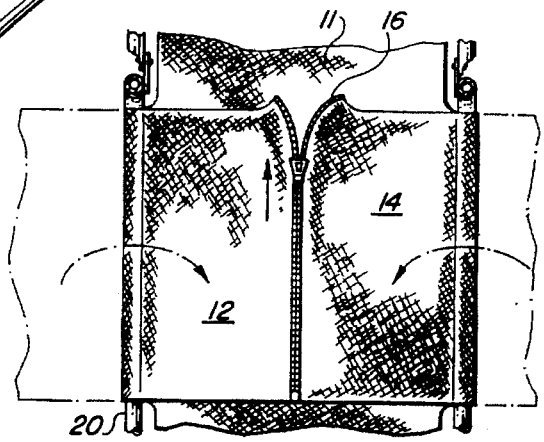
FIG. 4 is a plan view taken from below and partially cut away of my cover on an adjustable metal frame illustrating the two side panels being passed over the tubular side members of the frame and the ends of the two side panels being zipped together.

To secure cover 10 to frame 20, each of the two side panels 12 and 14 have means affixed to the edge of each side panel opposite to the edge sewn to center portion 11D of the elongated first panel for joining the two side panels together beneath frame 20. Although snaps, clips, strips of plastic hook and eye material can be used, my preferred embodiments utilizes a length of separable zipper material 16 sewn to each edge of side panels 12 and 14 as shown in FIGS. 3 and 4.

To fit cover 10 onto frame 20, the two U-shaped tubular ends of the frame are adjusted into a near vertical position and pocket 11A is slipped over the foot end of the frame and then the padded pocket 11B is slipped over the head end of the frame. Side panels 12 and 14 are then passed over the two elongated tubular side members of frame 20 and the side panels are joined together beneath the frame by zipper 16 as best shown in FIG. 4, thereby securing the cover to the frame and preventing any sagging of elongated first panel 11.

While I have shown and described a preferred form of my cover, such disclosure in no way limits the scope or extent of my invention whose scope is defined only by the appended claims.

I claim:

1. A removable unitary fabric cover for covering a folding metal lounge frame which has two adjustable cantilevered U-shaped tubular end members and two elongated tubular side members, said cover comprising an elongated first panel constructed of sturdy woven fabric, said panel having a center portion and two ends, one end being formed into a pocket adapted to fit over one end member of the metal frame and the opposite end of the panel also being formed into a pocket adapted to fit over the other end member of the frame, each pocket having a top portion adapted to lie above the end member of the frame and a bottom portion adapted to lie beneath the end member of the frame, one of the pockets having a layer of padding affixed to the underside of the top portion of the pocket and also having a hole through the middle portion of both the top and bottom portions of the pocket and its layer of padding, said hole being positioned and sized to comfortably support the face of a person on the lounge who is lying on his stomach, a pair of similar rectangular side panels of the same woven fabric used to construct the first panel, the edge of one side of each side panel permanently affixed to one side of the center portion of the first panel, and means located along the edge of each side panel opposite to the edge affixed to the first panel for joining together the two side panels and permits each side panel to pass over one of two tubular side members of the metal frame and then join the two side panels together beneath the first panel to firmly secure the cover onto the metal frame.

2. A cover for a lounge frame as set forth in claim 1 in which the means for joining together the two side panels consists of two lengths of separable zipper material, each length being sewn to one of the edges of one of the side panels.

* * * * *